US006120211A

United States Patent [19]

Raike

[11] Patent Number: 6,120,211

[45] Date of Patent: Sep. 19, 2000

[54] AIR DISTRIBUTION VALVE FOR PIVOTING IN TWO DIRECTIONS

[75] Inventor: George W. Raike, Hilton Head, S.C.

[73] Assignee: The Great Wave Co., Inc., Ashland, Ohio

[21] Appl. No.: 09/168,050

[22] Filed: Oct. 7, 1998

[51] Int. Cl.[7] ..... E02B 3/00

[52] U.S. Cl. ..... 405/79; 4/491; 137/875; 222/533; 193/23; 406/182

[58] Field of Search ..... 137/874, 875; 222/526, 527, 533, 544; 239/587.5, 587.6; 141/279, 328, 346, 387, 388; 193/23; 405/79; 4/491, 492; 472/128; 406/181, 182, 183

[56] References Cited

U.S. PATENT DOCUMENTS

| | | | |
|---|---|---|---|
| 83,176 | 10/1868 | Laird et al. . | |
| 1,219,009 | 3/1917 | Lane . | |
| 1,224,483 | 5/1917 | Megill . | |
| 1,226,104 | 5/1917 | Merrill . | |
| 2,991,803 | 7/1961 | Michie . | |
| 3,789,612 | 2/1974 | Richard et al. . | |
| 4,108,206 | 8/1978 | Mountain . | |
| 4,291,724 | 9/1981 | Miller . | |
| 4,310,022 | 1/1982 | Cohen . | |
| 4,347,922 | 9/1982 | Curry et al. | 193/23 |
| 4,467,483 | 8/1984 | Bastenhof . | |
| 4,469,135 | 9/1984 | Gray . | |
| 4,515,500 | 5/1985 | Bastenhof . | |
| 4,522,535 | 6/1985 | Bastenhof . | |
| 4,558,474 | 12/1985 | Bastenhof . | |
| 4,561,133 | 12/1985 | Laing . | |
| 4,619,562 | 10/1986 | Brännström . | |
| 4,692,949 | 9/1987 | Dunn . | |
| 4,730,355 | 3/1988 | Kreinbihl et al. . | |
| 4,730,807 | 3/1988 | Miller . | |
| 4,807,662 | 2/1989 | Verne . | |
| 4,812,077 | 3/1989 | Raike . | |
| 4,979,244 | 12/1990 | Bastenhof . | |
| 4,985,007 | 1/1991 | Ellis . | |
| 5,047,146 | 9/1991 | Bastenhof . | |

FOREIGN PATENT DOCUMENTS

| | | |
|---|---|---|
| 1226104 | 9/1987 | Canada . |

*Primary Examiner*—David Bagnell
*Assistant Examiner*—Sunil Singh
*Attorney, Agent, or Firm*—Shughart, Thomson & Kilroy P.C.

[57] ABSTRACT

An air distribution valve comprises a gimbal mounted flow directing nozzle connected to a feed conduit and selectively and pivotally advanceable about at least two intersecting and perpendicular axes into alignment with one of four outlet openings in a base plate each opening to an outlet conduit. The gimbal includes an outer gimbal ring supported in horizontal alignment above the base plate and an inner gimbal ring pivotally mounted to and inside the outer gimbal ring and rotatable about a first axis. The flow directing nozzle is pivotally mounted on mounting arms pivotally connected to the inner gimbal ring and pivotal about a second axis which intersects and extends perpendicular to the first axis. When used in a wave generating system, each outlet conduit communicates with one of four caissons at one end of the wave pool for selectively delivering pressurized air to the caisson from a centrifugal fan to force water out of the caissons in a selected order to create a desired wave pattern.

12 Claims, 4 Drawing Sheets

AIR DISTRIBUTION VALVE FOR PIVOTING IN TWO DIRECTIONS

BACKGROUND OF THE INVENTION

This invention relates to an air distribution valve for directing the flow of air through one of a plurality of conduits, and in particular such a valve that is particularly adapted for use in generating waves in a pool or for controlling the direction of flow of particulate matter entrained in a stream of air.

In my previous patent, U.S. Pat. No. 4,812,077, I disclosed an air delivery system for delivering pressurized air to a plurality of caissons in a wave generation system for wave pools. Pressurized air supplied from a fan through a feed line could be selectively directed through a swinging conduit or nozzle to one of two outlet conduits to alternatingly supply pressurized air to one of two caissons. Although this system has proven commercially successful, the system has limitation in its applications. There remains a need for an air delivery system which provides for greater variation in the number of caissons which can be supplied with pressurized air from a single feed line or fan outlet. It is foreseen that such a system could have application to materials handling systems as well wherein particulate material entrained in pressurized air could be selectively delivered to one of a plurality of downstream processing equipment or storage vessel.

SUMMARY OF THE INVENTION

The present invention comprises an air distribution valve having a gimbal mounted flow directing nozzle connected to a feed conduit and selectively and pivotally advanceable about at least two axes into alignment with one of a plurality of outlet conduits.

In a preferred embodiment, the air distribution valve includes a base plate with four openings formed therein each connected to an outlet conduit. The base plate comprises four quarter sections each sloping downwardly and inwardly to a central vertical axis. The openings are equally spaced away from the central vertical axis in closely spaced relation to one another.

The flow directing nozzle is cylindrical and mounted generally in vertical alignment above the base plate to a gimbal. An upper end of the nozzle is connected by a flexible conduit or sleeve to a distal end of the feed conduit which is positioned in vertical alignment above the air distribution valve.

The gimbal includes an outer gimbal ring and an inner gimbal ring. The outer gimbal ring is mounted in horizontal alignment above the base plate by support brackets extending upward from the base plate. The inner gimbal ring is pivotally mounted within the outer gimbal ring on an axially aligned first set of pivot pins extending outward from the inner gimbal ring on opposite sides thereof and mounted on bearings on the outer gimbal ring. The inner gimbal ring pivots about a first axis extending through the first set of pivot pins.

Mounting arms connected to the nozzle and extending vertically thereabove on opposite sides of the nozzle extend inside of the inner gimbal ring and are pivotally mounted on a second set of axially aligned pivot pins extending outward from the mounting arms into a second set of bearings on the inner gimbal ring. The second set of bearing are mounted on the inner gimbal ring ninety degrees from the first set of pivot pins and in planar alignment therewith. The nozzle therefore pivots about a second axis extending through the second set of axially aligned pivot pins which is perpendicular to and intersects the first axis of rotation about which the inner gimbal ring pivots. The nozzle is thereby pivotally advanceable about both axes and into alignment with each of the openings in the base and the associated outlet conduits.

Pivoting of the inner gimbal ring relative to the outer gimbal ring is controlled by a first pair of pneumatic actuators connected at a rear end to the outer gimbal ring and at a front end to the inner gimbal ring. Pivoting of the nozzle relative to the inner gimbal ring is controlled by a second pair of pneumatic actuators connected at a rear end to the inner gimbal ring and at a front end to the nozzle.

The air distribution valve is particularly well adapted for selectively directing pressurized air supplied from a centrifugal fan to one of four outlet conduits each connected to a separate caisson in a wave pool generating system. In addition, the air distribution valve is adapted for use in selectively directing a stream of air with particulate material entrained therein to one of four downstream storage vessels or processing equipment.

OBJECTS AND ADVANTAGES OF THE INVENTION

It is an object of this invention to provide an air distribution valve for selectively directing a stream of pressurized air to one of at least three outlet openings; to provide such a valve wherein the outlet openings are arranged about at least two axes; to provide such a valve having a flow directing nozzle selectively connecting a feed conduit to each of said outlet openings; to provide such a valve wherein said flow directing nozzle pivots about at least two intersecting and perpendicular axes; to provide such a valve wherein said flow directing nozzle can be quickly advanced from alignment with one outlet opening into alignment with any of the other outlet openings; to provide such a valve in which a lower rim of the nozzle may be positioned in closely spaced relation with a rim of each of the outlet openings; to provide such a valve which may be used to selectively supply pressurized air to a plurality of caissons in a wave generating pool to force water out of the caissons to generate waves; and to provide such a valve which may be used to selectively distribute particulate material entrained in a stream of air to one of a plurality of downstream storage vessels or processing equipment.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE INVENTION

Figure 1:
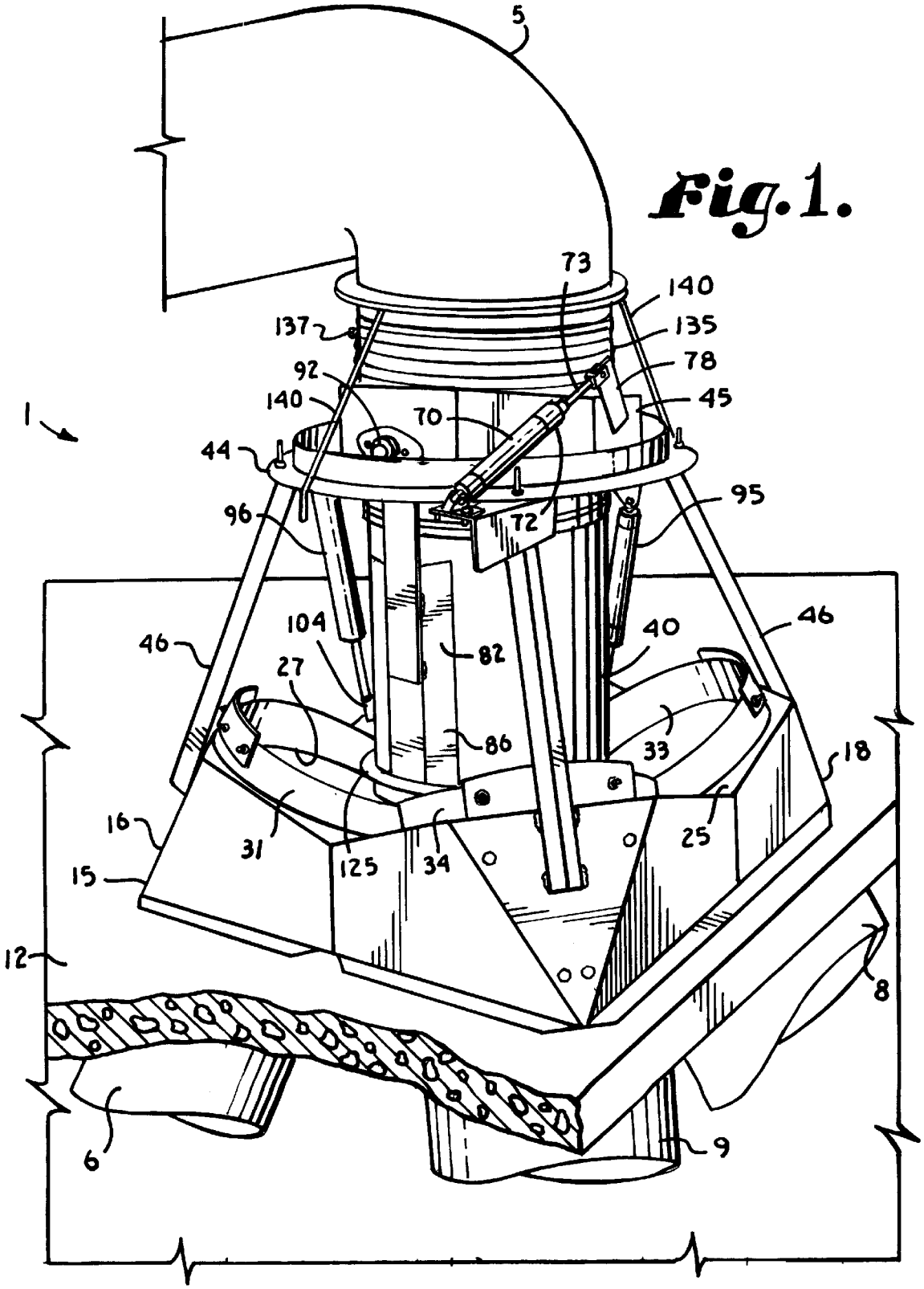
FIG. 1 is a fragmentary perspective view of an air distribution valve of the present invention shown connecting a feed conduit to four outlet conduits in a wave generating system.
Figure 2:
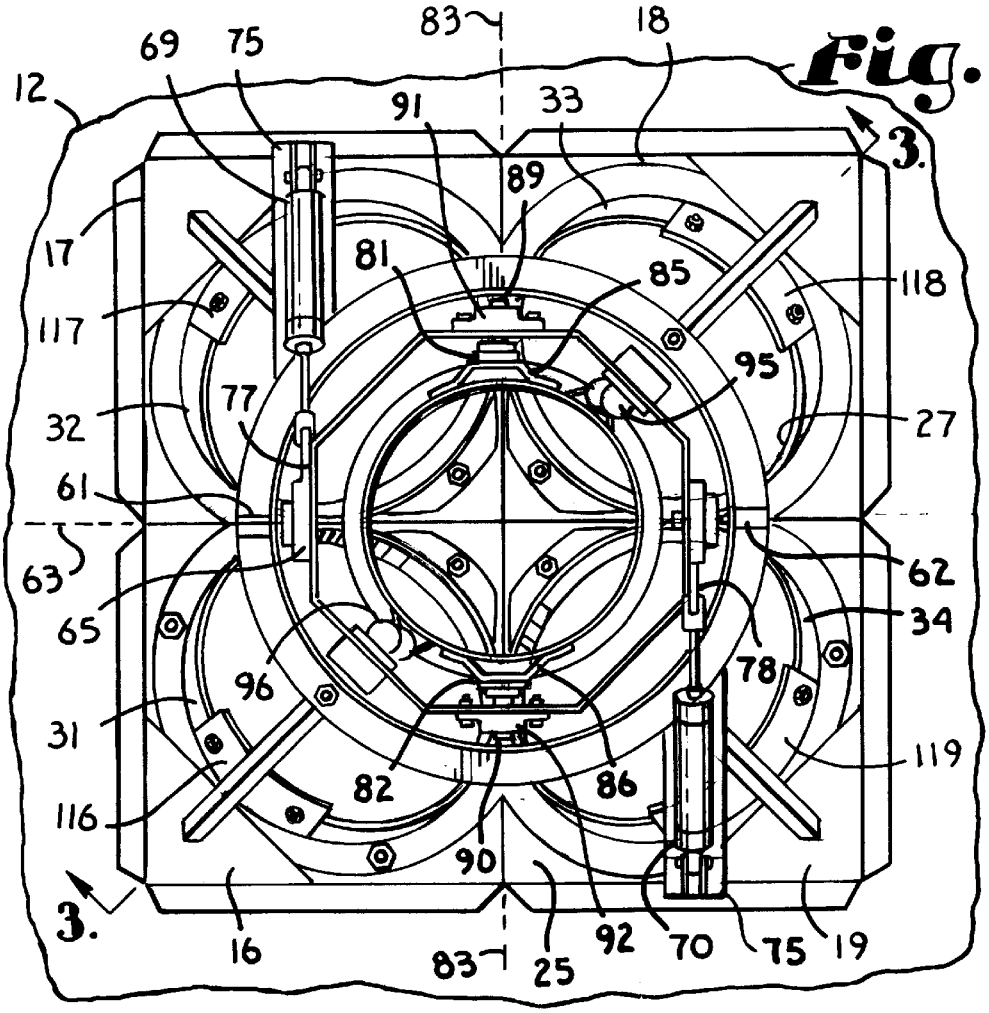
FIG. 2 is a top plan view of the valve.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Referring to the drawings in more detail, and in particular FIGS. 1–4, the reference numeral 1 refers to an air distribution valve of the present invention. The valve 1 is used to selectively distribute pressurized air from a feed line, conduit or duct 5 to one of four outlet ducts 6–9. The outlet ducts 6–9 are shown set in a concrete slab 12 in FIGS. 1, 3 and 4. The valve 1 is adapted for a variety of applications including the distribution of air to selected caissons to generate waves in a wave pool as discussed in more detail below or the distribution of particulate matter entrained in a stream of air to one of a plurality of storage vessels or processing equipment.

The valve 1 includes a base 15 which is mounted to the concrete slab 12 over the four outlet ducts 6–9. The base 15 comprises four, generally square, quarter sections 16–19. An upper surface 25 of each quarter section 16–19 of the base 15 slopes downwardly and inwardly toward the center of the base 15 at an angle of approximately 30 degrees. An opening 27 extends through the upper surface 25 of each quarter section 16–19. Collars 31–34 are secured to the upper surface 25 of the base quarter sections 16–19 respectively and extend above and below the openings 27 therein. The upper ends 36 of the outlet ducts 6–9 are shaped and sized for overlapping and abutting engagement with the collars 31–34 respectively when the base 15 is positioned over the upper ends 36 of the outlet ducts 6–9.

A flow directing nozzle 40 generally comprising a cylindrical tube is pivotally mounted above the base 15 on a gimbal 41. The gimbal 41 comprises an outer gimbal ring 44 and an inner gimbal ring 45. The outer gimbal ring 44 is mounted in horizontal alignment above the base 15 on support arms 46 which are secured to and extend upward from an outer corner of each base quarter section 16–19. The support arms 46 are formed from a length of angle iron with a threaded rod 51 secured to and extending upward from the upper end thereof.

The outer gimbal ring 44 includes an outwardly extending peripheral flange 53 and vertical sidewall 54. The outer gimbal ring 44 is mounted to the support arms 46 such that the threaded rods 51 extend through aligned apertures in the peripheral flange 53. Adjustment nuts 56 threadingly secured to each rod 51 on opposite sides of the peripheral flange 53 are used to adjust the distance between the outer gimbal ring 44 and the base 15.

The inner gimbal ring 45, which is octagonal in the embodiment shown, is pivotally mounted to the outer gimbal ring 44 on first and second pivot pins or rods 61 and 62. The first and second pivot pins 61 and 62 are welded to the outer gimbal ring 44 and extend inward from the vertical sidewall 54 on opposite sides thereof in axial alignment along a first axis 63. The first and second aligned pivot pins 61 and 62 are pivotally secured in or supported by first and second bearings 65 and 66 mounted on opposite sides of the inner gimbal ring 45 such that the inner gimbal ring 45 pivots about the first axis 63.

The inner gimbal ring 45 is pivoted relative to the outer gimbal ring 44 by first and second double acting pneumatic actuators 69 and 70 each comprising an air cylinder 72 and a piston 73. A rear end of each air cylinder 72 is pivotally mounted to one of a first and second support bracket 75 and 76. The support brackets 75 and 76 are secured to and extend outward from the outer gimbal ring 44 on opposite sides thereof. The distal end of each piston 73 is pivotally secured to one of a first and second lever arms 77 and 78. The first and second lever arms 77 and 78 are secured to and extend above the inner gimbal ring 45 on opposite sides thereof generally above bearings 65 and 66 respectively. The first and second pneumatic actuators 69 and 70 generally extend tangentially relative to the inner gimbal ring 45 on opposite sides thereof and perpendicular to the first axis 63. Pressurized air from a source, not shown, is used to actuate the pneumatic actuators 69 and 70 for pivoting the inner gimbal ring 45 relative to the outer gimbal ring 44 and about first axis 63.

The flow directing nozzle 40 is pivotally mounted to the inner gimbal ring 45 on first and second mounting arms 81 and 82 such that the nozzle 40 pivots about a second axis 83 which extends perpendicular to and intersects the first axis 63 at the center of the outer and inner gimbal rings 44 and 45. The first and second mounting arms 81 and 82 are mounted on first and second spacers 85 and 86 respectively extending outward from the cylindrical wall of the flow directing nozzle 40 on opposite sides thereof so as to space the mounting arms 81 and 82 away from the cylindrical wall of the flow directing nozzle 40 at the upper end of the cylindrical wall. The mounting arms 81 and 82 extend upward or parallel to a central axis of the cylindrical flow directing nozzle 40 and inside of the inner gimbal ring 45.

Third and fourth pivot pins 89 and 90 extend outward from the first and second mounting arms 81 and 82 respectively proximate the upper ends thereof and in axial alignment. The third and fourth pivot pins 89 and 90 are pivotally mounted in third and fourth bearings 91 and 92 which are mounted to the inner gimbal ring 45 on opposite sides thereof in axial alignment along the second axis 83. The third and fourth bearings 91 and 92 are mounted on the inner gimbal ring 45 in planar alignment with the first and second bearings 65 and 66 and spaced ninety degrees therefrom such that the first and second axes 63 and 83 intersect in perpendicular alignment.

The mounting arms 81 and 82 generally support the flow directing nozzle 40 below the inner gimbal ring 45 and permit the nozzle 40 to pivot about the second axis 83. Pivoting of the nozzle 40 is effectuated by third and fourth double acting pneumatic actuators 95 and 96 each comprising an air cylinder 97 and a piston 98. A rear end of each air cylinder 97 is pivotally mounted to one of a third and fourth support bracket 101 and 102. The support brackets 101 and 102 are secured to and extend outward from the inner gimbal ring 45 on opposite sides thereof. The distal end of each piston 98 is pivotally secured to one of a first and second mounting tabs 103 and 104. The first and second mounting tabs 103 and 104 are secured to the outer surface of the cylindrical wall of the flow directing nozzle 40 on opposite sides thereof proximate the first and second mounting arms 81 and 82 respectively. The third and fourth pneumatic actuators 95 and 96 generally extend tangentially relative to the cylindrical flow directing nozzle 40 on opposite sides thereof. Pressurized air from a source, not shown, is used to actuate the pneumatic actuators 95 and 96 for pivoting the nozzle 40 relative to the inner gimbal ring 45 and about second axis 83.

The components of the valve 1 including the nozzle 40, outer and inner gimbal rings 44 and 45, first and second pneumatic actuators 69 and 70 and third and fourth pneumatic actuators 95 and 96 are sized, shaped and positioned to permit the nozzle 40 to pivot at least 22 ½ degrees in any direction from a central axis 107 extending perpendicular to and intersecting the first and second axes 63 and 83 so as to generally extend through the center of the nozzle 40 and the outer and inner gimbal rings 44 and 45 when positioned in horizontal alignment such that the nozzle 40 hangs in a true vertical alignment. The nozzle 40 is thereby selectively positionable in alignment with all four of the collars 31–34 in base 15 and the associated outlet ducts 6–9.

Figure 4:
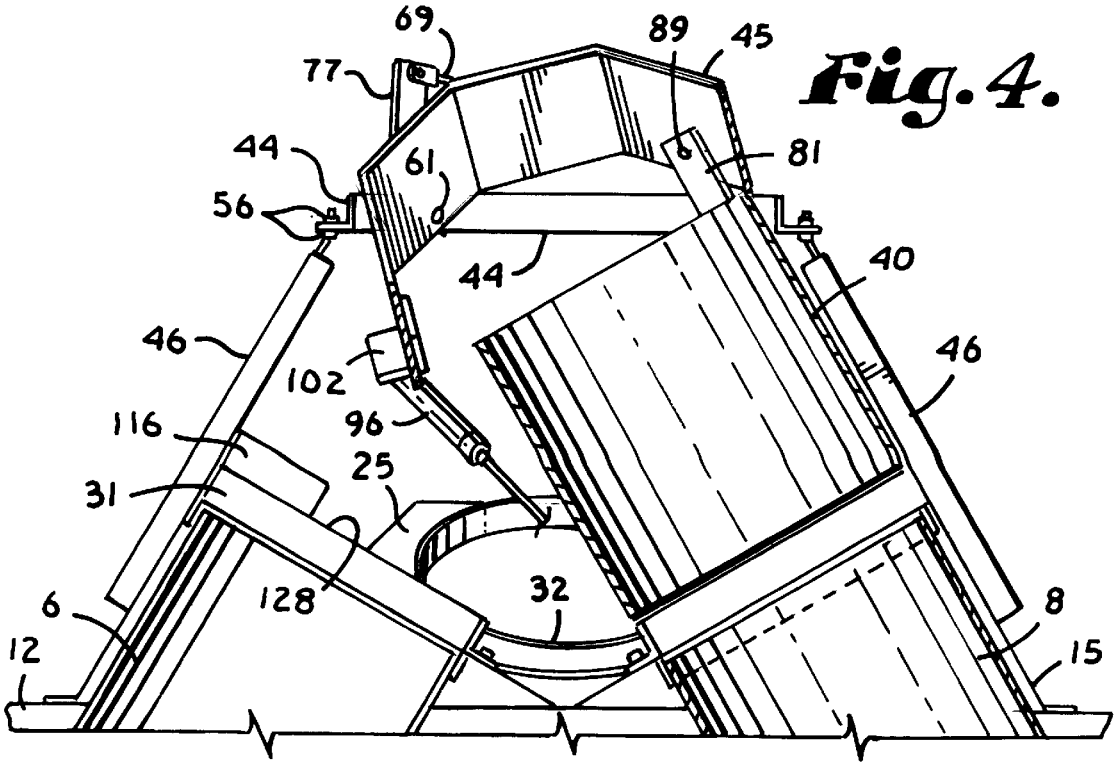
FIG. 4 is a view similar to FIG. 3 showing a flow directing nozzle of the valve repositioned.

In particular, full extension of piston 73 of first actuator 69 and full retraction of piston 73 of second actuator 70 in combination with full extension of piston 98 of third actuator 95 and full retraction of piston 98 of fourth actuator 96 positions the nozzle 40 in alignment with first outlet duct 6. By fully retracting piston 98 of third actuator 95 and fully extending piston 98 of fourth actuator 96, the nozzle is advanced from alignment with first outlet duct 6 and into alignment with the second outlet duct 7. Alternatively, by fully retracting piston 73 of first actuator 69 and fully extending piston 73 of second actuator 70, the nozzle 40 may be advanced from alignment with the first outlet duct 6 and into alignment with the fourth outlet duct 9. Alternatively, by changing the condition of the pistons on all of the actuators 69, 70, 95 and 96, the nozzle 40 may be advanced from alignment with the first outlet duct 6 and into alignment with the third outlet duct 8. FIG. 4 shows the nozzle 40 advanced into alignment with the second outlet duct 7.

Arcuate stops 116–119 are mounted to and extend above each of the collars 31–34. The stops 116–119 generally extend across the outer quarter arc of the collars 31–34 and include a padded cushion (not shown) secured to an inner face thereof. The stops 116–119 prevent the nozzle 40 from advancing past the collars 31–34 and ensure proper alignment of the nozzle 40 with the selected outlet duct 6–9. The pneumatic actuators 69, 70, 95 and 96 permit the nozzle 40 to be pivoted relatively rapidly with the typical amount of time required to advance the nozzle 40 from alignment with one outlet duct to another being approximately 2/10ths of a second. The padded cushions help cushion the rapid abutment of the nozzle 40 against the stops 116–119.

Needle back flow valves, not shown, may also be added to the cylinders 72 and 97 of pneumatic actuators 69 and 70 and 95 and 96 respectively to cushion, dampen or brake the advancement of the respective pistons 73 and 98 at either end of their strokes. In addition, the cylinders 72 and 97 are preferably of the type incorporating a pneumatic cushioning valve.

The nozzle 40 includes a lower rim sleeve 125 which is secured to the cylindrical wall of nozzle 40 and adjusted, prior to welding in place, to ensure the lower edge of the nozzle 40 extends in a plane which is parallel to the second axis of rotation. The height at which the upper edges 128 of each of the collars 31–34 extends above an upper surface of the base plate is adjustable, using shims or the like, to adjust the gap between a lower edge 126 of the lower rim sleeve 125 and upper edges 128 of each of the collars 31–34. In addition, the vertical position of the outer gimbal ring 44 is adjustable through vertical advancement of the adjustment nuts 56. After the valve 1 is assembled, the vertical position of the outer gimbal ring 44 and the position of the collars 31–34 are adjusted to provide the smallest gap possible between the lower edge 46 of the nozzle 40 and the upper edge 128 of each of the collars 31–34 without binding of the lower edge 46 of nozzle 40 against the collar upper edges 128. The resulting gap can be relatively small, approximately two one-hundredths of an inch.

Figure 3:
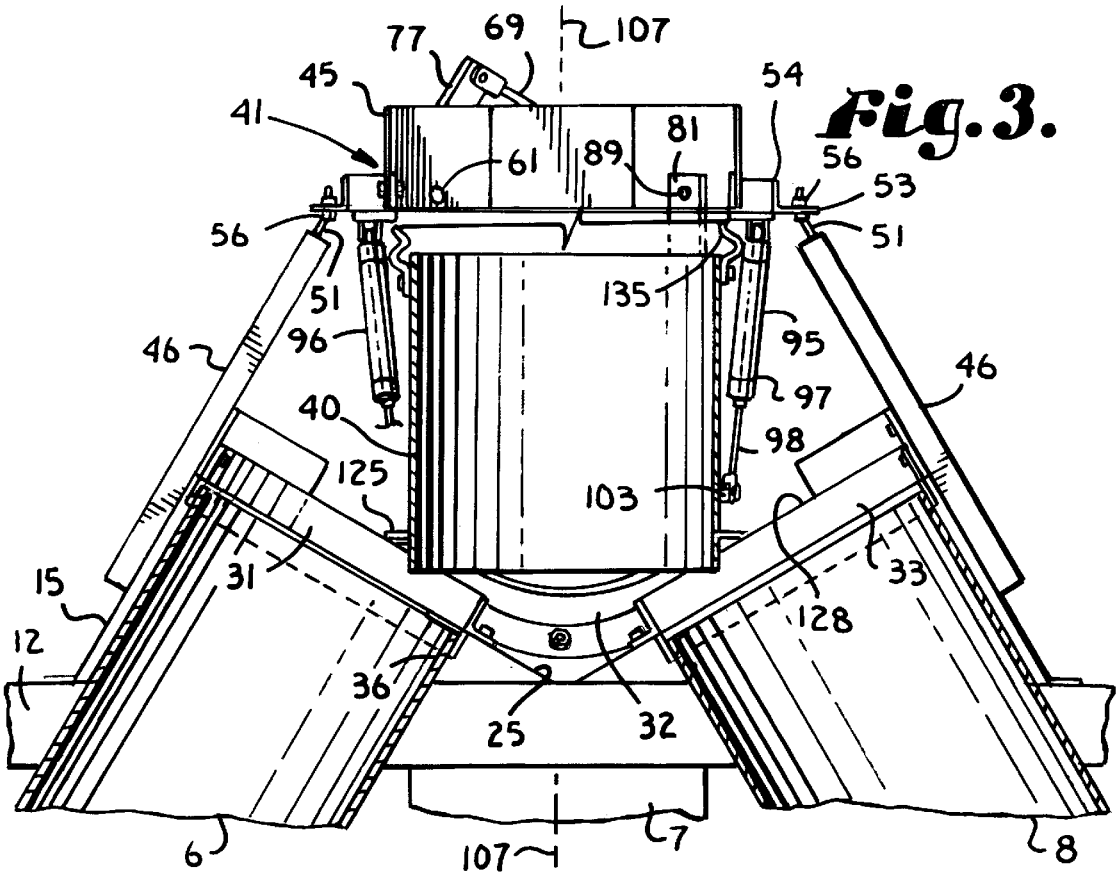
FIG. 3 is a fragmentary cross-sectional view taken along line 3—3 of FIG. 2.

The flow directing nozzle 40 is connected, at its upper end, to the feed conduit 5 by a flexible sleeve or conduit 135 positioned in overlapping relationship with an upper rim of the cylindrical wall of nozzle 40 and an outlet or discharge end of the feed conduit 5. Opposite ends of the flexible conduit 135 are connected to the upper end of the nozzle 40 and the outlet end of the feed conduit 5 by hose clamps 137. The mounting arms 81 and 82 are spaced away from the upper end of the cylindrical wall of nozzle 40 by spacers 85 and 86 to permit attachment of an end of the flexible conduit 135 to the upper end of the cylindrical wall of nozzle 40. The flexible conduit 135 is shown in FIGS. 1 and 3, but has been removed from FIGS. 2 and 4 for purposes of clarity.

The upper rim of the cylindrical wall portion of the nozzle 40 is spaced below the third and fourth pivot pins 89 and 90 on the mounting arms 81 and 82 by approximately three inches. Similarly the distal end of the feed conduit 5 is spaced above the first and second pivot pins 61 and 62 approximately three inches.

Support struts 140, secured at one end to the outer gimbal ring 44 and at opposite ends to the feed conduit 5 support the outlet end of the feed conduit 5 generally above the valve 1 and in alignment with central axis 107.

The valve 1 is particularly adapted for use in a hydraulic wave generation system for wave pools of the type disclosed in my previous patent, U.S. Pat. No. 4,812,077, which is incorporated herein by reference. As discussed in U.S. Pat. No. 4,812,077, pressurized air is selectively directed from a centrifugal fan to a series of caissons formed at one end of the pool and open to the bottom of the pool. Pressurizing a caisson through the injection of pressurized air at an upper end thereof forces the water level down below the static water level forcing water out the bottom of the caisson creating a swell on the other side of the caisson. Subsequently depressurizing of the caisson back to atmospheric pressure, by directing the source of pressurized air to a different caisson allows the water level rise within the caisson such that water is flows back in through the bottom thereof. Selectively pressurizing and depressurizing the system of caissons can be controlled to produce a desired waive pattern.

Figure 5:
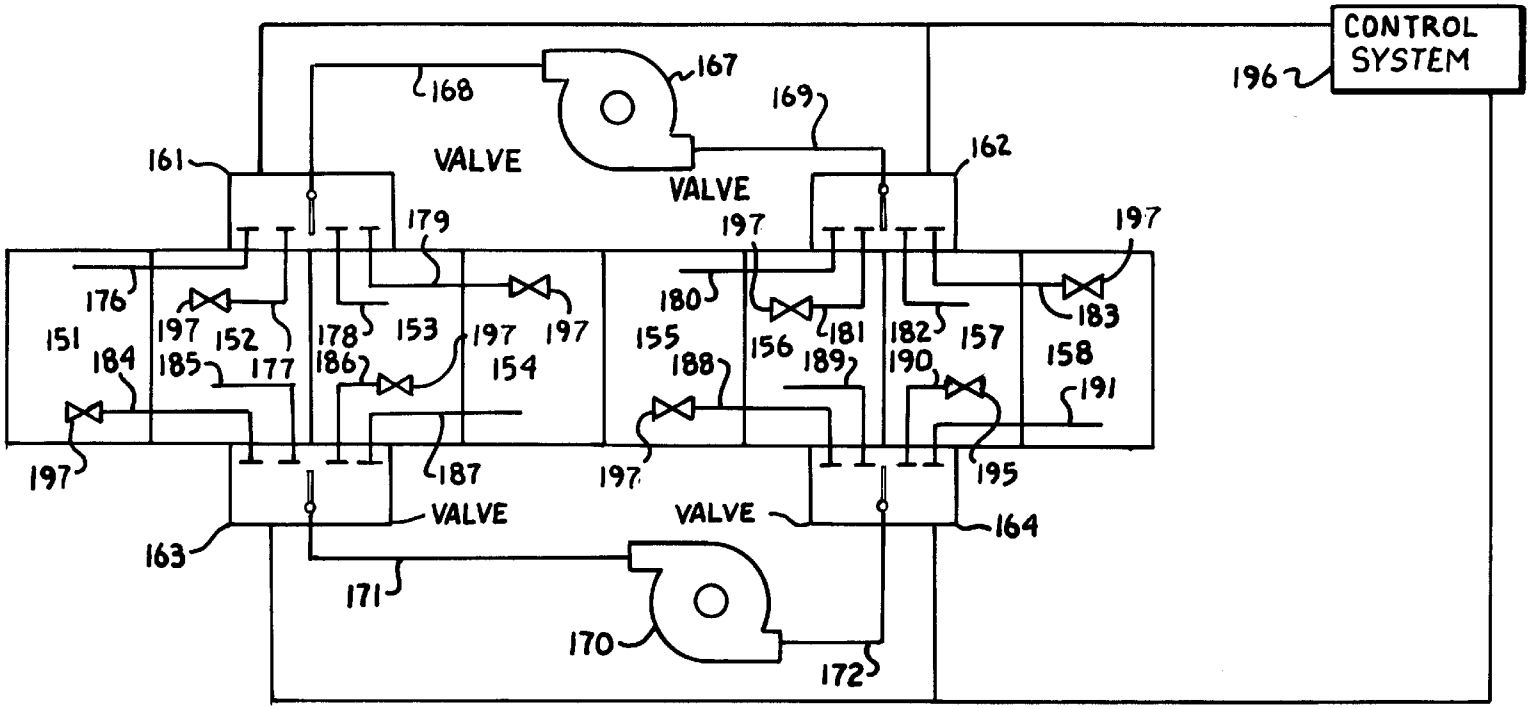
FIG. 5 is a schematic diagram of a wave generating system for a wave pool incorporating the valve of the present invention.

FIG. 5 is a schematic diagram of a pneumatic wave generating system for a wave pool 150 having eight caissons 151–158 and four four-way valves 161–164 of the type discussed above as air distribution valve 1. A first dual outlet centrifugal fan 167 supplies pressurized air to the first valve 161 through first feed line 168 and to the second valve 162 through second feed line 169. A second dual outlet centrifugal fan 170 supplies pressurized air to the third valve 163 through third feed line 171 and to the fourth valve 164 through fourth feed line 172.

First valve 161 selectively supplies pressurized air from first fan 167 to first caisson 151, second caisson 152, third caisson 153 and fourth caisson 154 through outlet conduits 176–179 respectively. Second valve 162 selectively supplies pressurized air from first fan 167 to fifth caisson 155, sixth caisson 156, seventh caisson 157 and eighth caisson 158 through outlet conduits 180–183 respectively. Third valve 163 selectively supplies pressurized air from second fan 170 to first caisson 151, second caisson 152, third caisson 153 and fourth caisson 154 through outlet conduits 184–187 respectively. Fourth valve 164 selectively supplies pressurized air from second fan 170 to fifth caisson 155, sixth caisson 156, seventh caisson 157 and eighth caisson 158 through outlet conduits 188–191 respectively.

Figure 6:
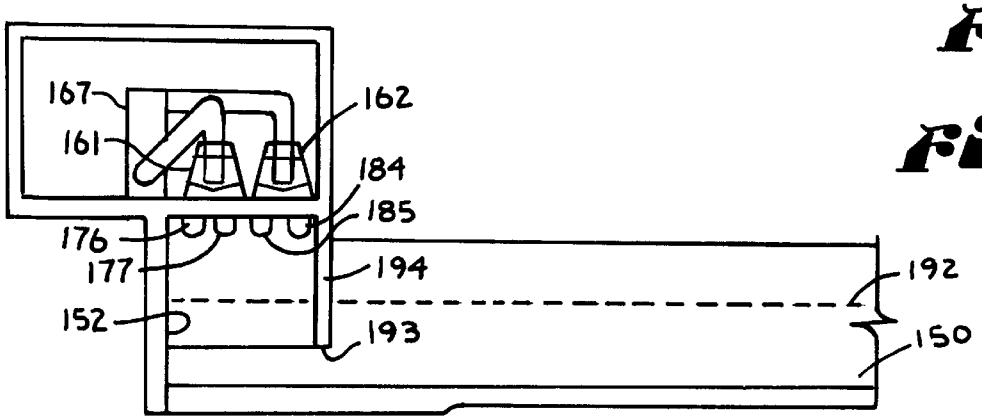
FIG. 6 is a fragmentary and simplified cross-sectional view of a wave pool incorporating the valve of the present invention.

FIG. 6 generally comprises a cross-sectional view of wave pool 150 showing one of the caissons, such as second caisson 152. The static water level is shown as broken line 192. Pressurized air supplied to caisson 152 through either or both outlet conduits 177 or 185 forces the water level therein down forcing water out an opening 193 at a lower end of a front wall 194 of caisson 152 producing a swell in front of front wall 194 as discussed above. When the pressurized air is allowed to escape from second caisson 152 as discussed in more detail below, water flows back through the opening 193 into caisson 152.

The valves 161–164 are pneumatically connected to a control system 196 which controls the delivery of high pressure air to the pneumatic actuators in valves 161–164 (of the type discussed above) to control the order and timing of delivery of pressurized air from fans 167 and 170 to caissons 151–158 to produce the desired wave patterns. For example, the control system 196 could be programmed to alternatingly supply pressurized air to first, second, fifth and sixth caissons 151, 152, 155 and 156 and then to third, fourth, seventh and eighth caissons 153, 154, 157 and 158. Alternatively, the control system 196 could be programmed to alternatingly supply pressurized air to first, third, fifth and seventh caissons 151, 153, 155 and 157 and then to second, fourth, sixth and eighth caissons 152, 154, 156 and 158. Alternatively, pressurized air could be supplied from two outlet conduits to a single caisson simultaneously to produce bigger waves. For example, in a first air injection stroke, the nozzles in valves 161–164 could be initially set to direct pressurized air to first caisson 151 through outlet conduits 176 and 184 and to fifth caisson 155 through outlet conduits 180 and 188. In a second air injection stroke, the nozzles in valves 161–164 would be moved to direct pressurized air to second caisson 152 through outlet conduits 177 and 185 and to sixth caisson 156 through outlet conduits 181 and 189. In a third air injection stroke, the nozzles in valves 161–164 would be moved to direct pressurized air to third caisson 153 through outlet conduits 178 and 186 and to seventh caisson 157 through outlet conduits 182 and 190. In a fourth air injection stroke, the nozzles in valves 161–164 would be moved to direct pressurized air to fourth caisson 154 through outlet conduits 179 and 187 and to eighth caisson 158 through outlet conduits 183 and 191. The control system 196 would then continuously repeat the four air injection strokes. Air is typically injected into a caisson during each stroke for approximately one second.

As can be appreciated, the order and sequence in which pressurized air is delivered to the caissons 151–158 can be varied significantly to produce a desired wave pattern. It is also to be understood that the positioning of the fans 167 and 170 and the arrangement of the outlet conduits 176–191 can be varied.

In the air distribution valves 161–164, when the flow directing nozzle of the valve is not aligned with an associated outlet conduit, that outlet conduit is open to atmosphere. With respect to valve 161, if the nozzle of valve 161 is aligned with conduit 176 so as to pressurize first caisson 151, conduits 177, 178 and 179 are open to atmosphere back through valve 161 such that the second, third and fourth caissons 152, 153 and 154 respectively are also open to atmosphere. If the nozzle is then aligned with outlet conduit 177, to pressurize second caisson 152, outlet conduit 176 and first caisson 151 are open to atmosphere, allowing pressurized air in first caisson 151 to escape back through outlet conduit 176, depressurizing first caisson 151 and allowing the water level therein to rise.

In the wave generating system shown schematically in FIG. 5, two outlet conduits open into each caisson. In many wave generating applications utilizing this system, pressurized air might be delivered to a caisson only through one or a first of the two outlet conduits. If the second of the two outlet conduits is left open to atmosphere, the pressurized air will escape through the second of the two outlets preventing the caisson from pressurizing. Therefore, a one-way valve, also referred to as a backflow restrictor or a check valve, is attached to one of the two outlet conduits to only permit the flow of air into the caisson but not back through the outlet conduit.

For example, referring to the schematic diagram of FIG. 5, one way valves 197 are shown secured to the ends of outlet conduit 184 in first caisson 151, outlet conduit 177 in second caisson 152, outlet conduit 186 in third caisson 153, outlet conduit 179 in fourth caisson 154, outlet conduit 188 in fifth caisson 155, outlet conduit 181 in sixth caisson 156, outlet conduit 190 in seventh caisson 157 and outlet conduit 183 in eighth caisson 158. When pressurized air is delivered to first caisson 151 through outlet conduit 176 but not outlet conduit 184, the one way valve 197 on outlet conduit 184 prevents the pressurized air from flowing back therethrough and venting to atmosphere.

Figure 7:
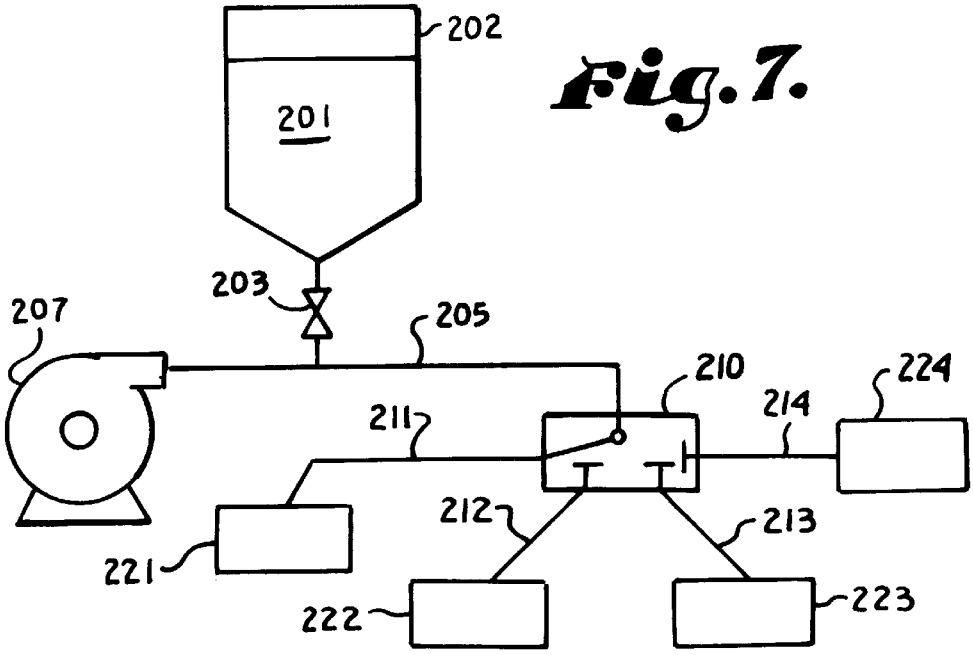
FIG. 7 is a schematic diagram of a materials handling system using the air distribution valve of the present invention.

It is also foreseen that the valve 1 of the present invention could be used for directing the flow of a stream of air with particulate entrained therein to one of a plurality of storage containers, process lines or the like. For example, FIG. 7 is a schematic diagram of a materials handling system. Particulate material 201 is fed from hopper 202, through valve 203 and into feed line 205, downstream from centrifugal fan 207 such that the particulate material 201 is entrained in the stream of air from the fan 207. Feed line 205 is connected to air flow distribution valve 210, of the same construction as valve 1 discussed above.

Distribution valve 210 selectively directs the stream of air with particulate material 201 entrained therein, to one of four outlet conduits 211, 212, 213 and 214 which are connected to storage vessels or downstream processing equipment 221, 222, 223 and 224 respectively. In FIG. 7, the valve 210 is shown schematically directing the stream of air with particulate material entrained therein through outlet conduit 211 to vessel or processing equipment 221.

When utilizing the valve 210 to change the downstream equipment or vessel to which material 201 is to be delivered, it may be preferable to first close valve 203 and then reposition the flow directing nozzle in valve 210 after sufficient time has elapsed to allow any material remaining in feed line 205 to blow through valve 210. Once the nozzle is repositioned, the valve 203 would be reopened to renew the flow of material 201 into feed line 205.

Although the valve 1 is shown mounted and described in a vertical orientation wherein the gimbal 41 is mounted vertically above the base plate 15, it is to be understood that the valve 1 could be mounted in almost any orientation at any angle. For example, the valve 1 could be mounted generally horizontally such that the gimbal 41 extends to the side of the base plate 15.

It is also foreseen that multiple valves 1 of the present could be aligned in series to increase the number of outlets to which pressurized air from the feed conduit 5 could be directed. For example, if four valves 1 are positioned in communication with the four outlet conduits of a first valve, the system would present sixteen outlets to which pressurized air from the blower could be selectively directed.

It is to be understood that while certain forms of the present invention have been illustrated and described herein, it is not to be limited to the specific forms or arrangement of parts described and shown.

What is claimed and desired to be secured by Letters Patent is as follows:

1. An air distribution valve for selectively directing a stream of pressurized air from a feed conduit to one of at least three outlet conduits; said air distribution valve comprising:

a) a base having at least three outlet openings extending through said base each in communication with one of said outlet conduits;

b) an outer gimbal ring mounted in spaced relation to said base;

c) an inner gimbal ring pivotally mounted within said outer gimbal ring and pivotal about a first axis; and d) a flow directing nozzle pivotally connected at a first end thereof to said inner gimbal ring and pivotal about a second axis; said second axis intersecting and extending perpendicular to said first axis such that said nozzle is selectively advanceable into alignment with each of said outlet openings in said base; said nozzle is connectable at said first end thereof to said feed conduit by a flexible conduit.

2. The air distribution valve as in claim 1 wherein:

a) said nozzle comprises a tube having a pair of mounting arms secured on opposite sides of said tube such that said mounting arms are spaced away from an outer surface of said tube at said first end thereof; said flexible conduit connected to said outer surface of said tube at said first end thereof inside of said mounting arms; said nozzle connected to said inner gimbal ring by axially aligned pivot pins extending outward from said mounting arms at distal ends thereof.

3. The air distribution valve as in claim 1 for selectively directing the stream of pressurized air from the feed conduit to one of four outlet conduits wherein:

a) said base has four outlet openings extending therethrough each in communication with one of said four outlet conduits; said four outlet openings equally spaced about a central axis extending through said base.

4. The air distribution valve as in claim 3 wherein:

a) said base comprises four quarter sections each having an outer surface; each of said four outlet openings is formed in said outer surface of one of said quarter sections.

5. The air distribution valve as in claim 1 wherein:

a) said outer gimbal ring is mounted in spaced relation to said base on a plurality of mounting brackets secured at a first end to said base and at a distal end to said outer gimbal ring.

6. The air distribution valve as in claim 5 wherein:

a) said outer gimbal ring is mounted on threaded rods extending outward at distal ends of said mounting brackets such that the orientation of said outer gimbal ring relative to said base is adjustable.

7. A wave generator comprising:

a) a pool having first, second, third and fourth caissons extending across one end of said pool and each opening at a lower end into said pool;

b) a first outlet conduit communicating with said first caisson; a second outlet conduit communicating with said second caisson; a third outlet conduit communicating with said third caisson; and a fourth outlet conduit communicating with said fourth caisson;

c) a blower;

d) a feed conduit flow connected to said blower: and e) a flow directing nozzle connected at a first end to a discharge end of said feed conduit by a flexible conduit and pivotally mounted on a gimbal and pivotal about first and second axes extending in perpendicular and intersecting alignment above first, second, third and fourth inlet openings to said first, second, third and fourth outlet conduits; said nozzle selectively pivotal into alignment with said first, second, third and fourth inlet openings for directing pressurized air therethrough from said feed conduit.

8. The wave generator as in claim 7 further comprising:

a) a base through which said first, second, third and fourth inlet openings extend;

b) said gimbal comprises:

i) an outer gimbal ring mounted in spaced relation to said base;

ii) an inner gimbal ring pivotally mounted within said outer gimbal ring and pivotal about said first axis; and iii) said flow directing nozzle is pivotally connected at the first end thereof to said inner gimbal ring and pivotal about said second axis.

9. The wave generator as in claim 8 wherein:

a) said flow directing nozzle comprises a tube having a pair of mounting arms secured on opposite sides of said tube such that said mounting arms are spaced away from a first end of said tube; said flexible conduit connected to said first end of said tube inside of said mounting arms; said nozzle connected to said inner gimbal ring by axially aligned pivot pins extending outward from said mounting arms at distal ends thereof.

10. The wave generator as in claim 8 wherein:

a) said base comprises four quarter sections each having an outer surface sloping inwardly toward a central axis and away from said gimbal and wherein each of said inlet openings is formed in an upper surface of one of said quarter sections.

11. The wave generator as in claim 8 wherein:

a) said outer gimbal ring is mounted in spaced relation to said base on a plurality of mounting brackets secured at a first end to said base and at a second end to said outer gimbal ring.

12. The wave generator as in claim 11 wherein:

a) said outer gimbal ring is mounted on threaded rods extending outward at distal ends of said mounting brackets such that the orientation of said outer gimbal ring relative to said base is adjustable.

* * * * *